United States Patent [19]

Gaiatto et al.

[11] Patent Number: 5,005,220

[45] Date of Patent: Apr. 9, 1991

[54] PROTECTION HELMET

[75] Inventors: Daniele Gaiatto, Vigevano; Gianni Menguzzato; Michelle Villis, both of Vicenza, all of Italy

[73] Assignee: Brancale S.R.L., Vigevano, Italy

[21] Appl. No.: 382,472

[22] Filed: Jul. 17, 1989

[30] Foreign Application Priority Data

Jul. 21, 1988 [IT] Italy ..... 85618 A/88

[51] Int. Cl.[5] ..... A42B 3/02

[52] U.S. Cl. ..... 2/421; 24/265 BC

[58] Field of Search ..... 2/421, 424, 452, 10, 2/6; 24/265 R, 265 BC, 163 R, 193, 170

[56] References Cited

U.S. PATENT DOCUMENTS

| | | | |
|---|---|---|---|
| 3,818,548 | 6/1974 | Meyerson | 24/170 |
| 4,461,044 | 7/1984 | Reiterman et al. | 2/421 |
| 4,464,799 | 8/1984 | Nava | 2/421 |
| 4,564,960 | 1/1986 | Nishiyama | 2/452 |
| 4,815,175 | 3/1989 | Kasai | 24/193 |

*Primary Examiner*—Peter Nerbun

*Attorney, Agent, or Firm*—Bucknam and Archer

[57] ABSTRACT

The helmet comprises a crown (1) with belts (2) which are blocked from moving with respect to the crown by means of buckles (3). The belts are wound on the buckles. The buckles are inserted in slits (6) formed on the crown (1) along its entire thickness. Recesses (7) are formed on the external surface of the crown. The buckles (3) fit into the recesses so that the external surface of the buckles is essentially on the level of the external surface of the crown (1).

8 Claims, 2 Drawing Sheets

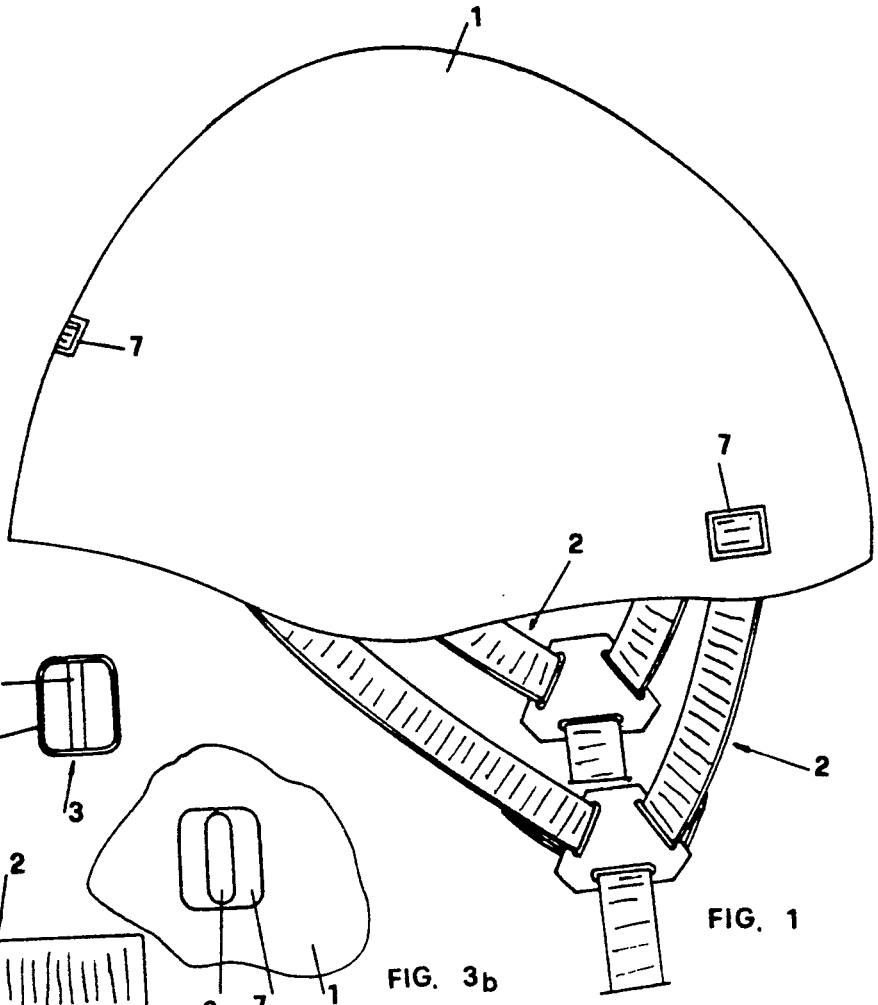
FIG. 1
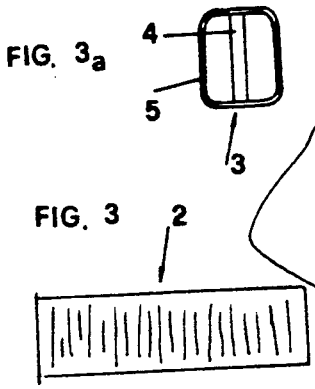
FIG. 3a
FIG. 3
FIG. 3b
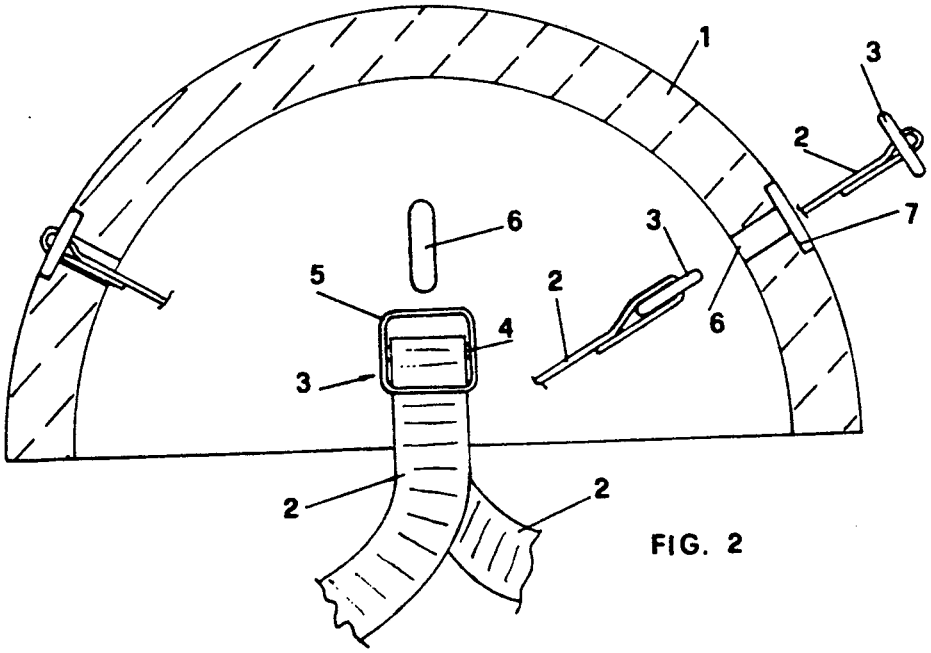
FIG. 2

PROTECTION HELMET

The present invention relates to protection helmets. It is known that protection helmets used in cycling, both on the road as well as on a track, consist of a crown usually made of polystyrene or similar material capable of absorbing impacts. The crown is made to fit on the head of the user, being held in position by means of a plurality of belts which hold, depending on the case, the lateral and posterior part of the head as well as the part which fits under the chin of the user so that the helmet is held firmly onto the head of the user, and in this manner, the helmet may perform its protective function in case of impact which could be dangerous for the user.

According to the present state of the art, these belts are caused to pass through buckles corresponding to the fixing points to the crown, in locations corresponding so the locations where they must be fixed to the crown, the buckles being fixed firmly to the same helmet by means of rivets or other fixed connection means.

This manner of operation results however quite expensive, particularly due to the substantial period of time required by the operator in order to insure the fixing of the buckles to the helmet. Further, the apparatuses which permit to achieve this system of connection are rather expensive, a fact which affects in final analysis, the final cost of the helmet.

An object of the present invention is to provide an helmet provided with a particular device so that the connection between the belts and the helmet is very simple for the operator and at the same time very safe for the user.

In accordance with the invention, the belts mentioned hereinabove pass around buckles and the buckles are inserted in slits made on the helmet and are therefore, blocked in the interior of recesses of shape corresponding to the shape of the buckles so that the buckles, in the blocking position of the belts in the desired position do not protrude from the external surface of the helmet.

Due to this particular shape, the belts present blocking points to the helmet which are safe and further, the fixing of the belts to the helmet itself presents the same properties of safety which have been provided by the fixing devices already known.

The invention will now be described in detail by reference to the attached drawings of each:

FIG. 1 is the overall side view of the helmet according to the invention;

FIG. 2 is a cross-section of the helmet of FIG. 1.

Figures 4, 5, 6, 7:
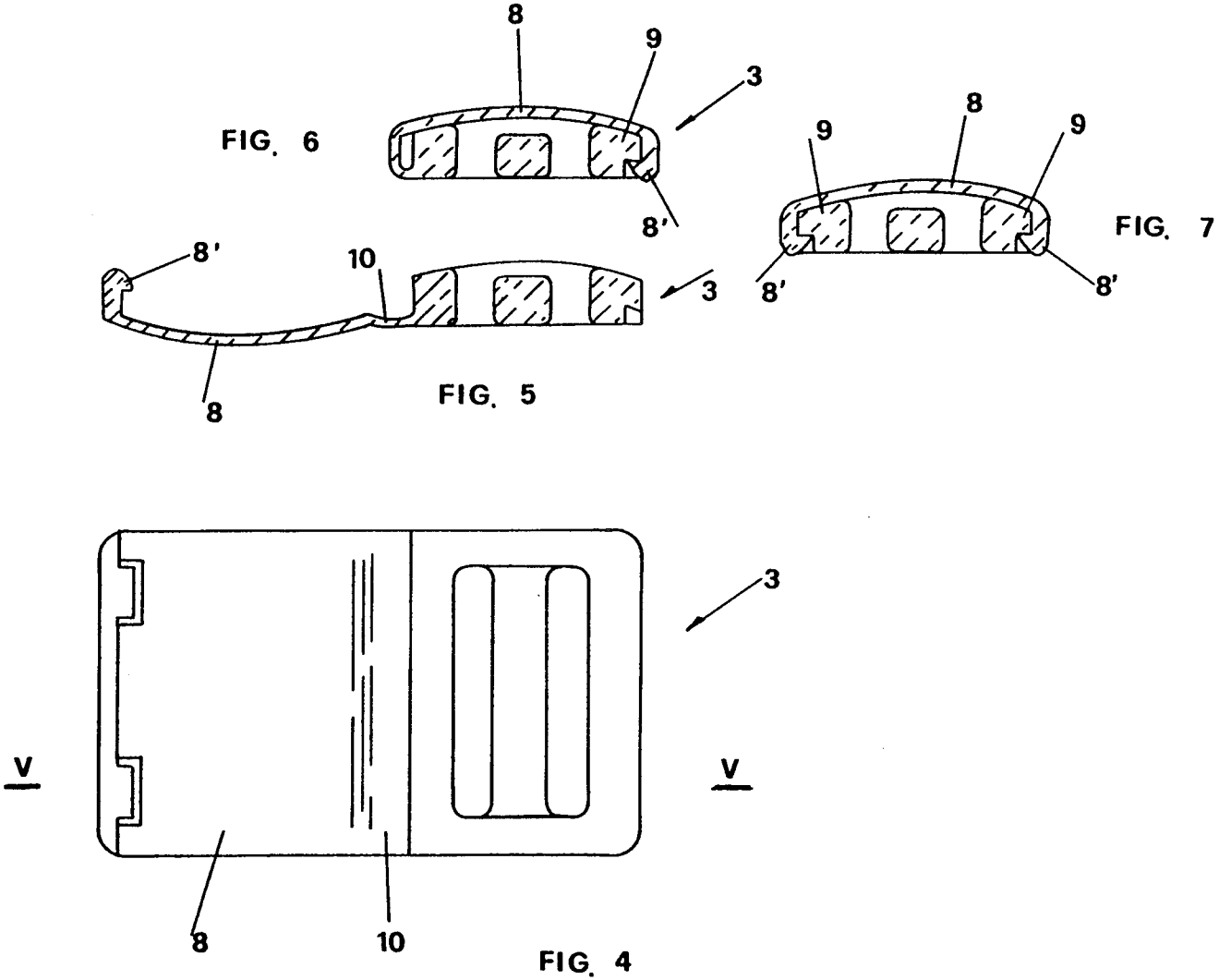

FIGS. 3, 3*a*, and 3*b* illustrate some details of the device of the present invention;

FIG. 4 illustrates a planar view of a particular buckle to be used according to the present invention;

FIG. 5 and 6 both illustrate a cross-section along lines V—V of FIG. 4 of the buckle mentioned hereinabove in position open and closed respectively.

FIG. 7 illustrates a cross-section of another embodiment of the buckle according to the present invention.

As shown in FIG. 1, the helmet comprises a crown with a plurality of belts 2 for holding the crown to the head of the user. These belts further are fixed reciprocally by hooking means well known in the art, (not shown).

An essential characteristic of the present invention resides in the fact that the reciprocal fixing between the belts and the crown is achieved by means of buckles 3 which, according to a preferred embodiment, consist of a frame 5 essentially of rectangular shape with a bar 4 corresponding to the longitudinal central axis. The belt is caused to pass around the bar 4. The belts may pass around the bar 4 so as to form a loop as shown in FIG. 2 on the side, or may simply pass around the bar 4 (central position shown in FIG. 2), without any structure to hold them.

Another essential feature of the invention resides in the fact that slits 6 are made on the crown 1, the slits having an elongated shape and going through the entire thickness of the crown, the width of the slits being such as to allow the passage of the buckles 3 as well as the belt which has gone around the same buckle.

On the external surface of the crown there is formed a recess 7 of shape corresponding to the shape of the buckle. The same buckle is caused to rest in the recess so that the same buckle is caused to be placed with its external surface exactly at the level of the external surface of the crown so that the continuity of the crown does not vary.

It should be stressed that the specific shape of the buckle 3 is not significant for the purpose of achieving an effective device. Essentially the buckle should not necessarily be formed by a frame with a longitudinal bar but could consist of any other element around which the buckle may turn with at least two slits and exactly one for the entry and one for the exit of the belt which engages in this manner with the element in question.

The invention also may provide for plugs which are placed above the crown in locations corresponding to the locations in which buckles 3 are placed which have essentially the function of coverings for aesthetic reasons. In particular the buckle 3 may present as shown in FIGS. 4–7, an element 8 for covering which is placed on the face of the buckle and which is placed on the external surface. This element has at least one border 8' in the shape of a hook which is intended to attach itself in the closing position with the external squared side border 9 of the buckle.

According to one embodiment, the covering element 8 is integral with the buckle itself and is connected to it by means of segment 10 which is an element of connection and which is placed corresponding to one of the lateral borders of the buckle. The possibility of placing the covering element above the buckle itself is ensured by the flexibility of the material.

According to the embodiment shown in FIG. 7, both external lateral borders 9 of the buckle have a squared shape and they are attached to the borders 8' which have the shape of a hook and which are formed on both sides of the element 8.

It should be stressed that the invention is applicable also to helmets of the type having two superimposed layers which, in general, are formed by an internal layer of polystyrene which is covered externally by a layer of plastic material. In this case the slit 6 is formed corresponding to the more external layer of the material but it is not excluded that also a part of the internal layer of the material could be involved.

What is claimed is:

1. A protection helmet for a user which comprises crown (1), a plurality of belts (2), said belts being blocked from moving with respect to the crown at least at one location, said belts being fixed one to the other, means for fixing said belts with respect to the crown whereby said helmet is held firmly on the head of the user, said means comprising buckles (3), at least one slit for the entry and one slit for the exit of each belt in each buckle, each of said buckles being inserted in a slit (6) formed along the entire thickness of the helmet at at least one location, said slit (6) having a width at least equal to the thickness of the buckle with the belt wound thereon, at least one recess (7) formed on the external surface of said crown, said recess having a shape corresponding to the shape of the buckle, whereby said buckle with the belt may pass through said slit.

2. The helmet according to claim 1 wherein said belt has a portion which is placed upstream and another portion which is placed downstream of the buckle and said portions are joined reciprocally so as to form a loop wherein said buckle is blocked.

3. The helmet according to claim 1 wherein said belt consists of two superimposed portions, said slit (6) engaging both portions, said recess (7) being formed on at least the outside surface of said helmet.

4. The helmet according to claim 1 wherein said buckle (3) consists essentially of a rectangular frame (5), and a bar (4) longitudinally disposed is position corresponding to the central axis of symmetry of said frame.

5. The helmet according to claim 1 which comprises at least one plug placed above said buckle (3).

6. The helmet according to claim 5, wherein said plug consists of a covering member (8), said member (8) having at least one lateral border (8') in the shape of a hook, said buckle having at least one lateral border (9), of the lateral border (9) of the buckle having a square shape, said lateral border (8') of said member in the closing position engaging with said lateral border (9) of said buckle.

7. The helmet according to claim 6 wherein said covering member (8) is integral with said buckle (6) and is connected thereto through a segment (10), said segment being placed in position according to one of the lateral borders of said buckle, said segment (10) being made of resilient material whereby said member (8) may be placed above said buckle.

8. The helmet according to claim 6 wherein said covering member (8) has its lateral border (8') in the shape of a hook whereby said lateral border of said member engages with the corresponding lateral border of said buckle (3).

* * * * *